US007973593B2

(12) United States Patent
Kitamura

(10) Patent No.: US 7,973,593 B2
(45) Date of Patent: Jul. 5, 2011

(54) REFERENCE VOLTAGE GENERATION CIRCUIT AND START-UP CONTROL METHOD THEREFOR

(75) Inventor: Yuusuke Kitamura, Kanagawa (JP)

(73) Assignee: Renesas Electronics Corporation, Kanagawa (JP)

( * ) Notice: Subject to any disclaimer, the term of this patent is extended or adjusted under 35 U.S.C. 154(b) by 0 days.

(21) Appl. No.: 12/318,690

(22) Filed: Jan. 6, 2009

(65) Prior Publication Data

US 2009/0189454 A1 Jul. 30, 2009

(30) Foreign Application Priority Data

Jan. 28, 2008 (JP) ..... 2008-016572

(51) Int. Cl.
*G05F 1/10* (2006.01)

(52) U.S. Cl. ..... 327/539; 327/538

(58) Field of Classification Search ..... 327/539
See application file for complete search history.

(56) References Cited

U.S. PATENT DOCUMENTS

| | | | | |
|---|---|---|---|---|
| 4,857,823 | A * | 8/1989 | Bitting | 323/314 |
| 5,109,187 | A * | 4/1992 | Guliani | 365/185.21 |
| 5,867,013 | A * | 2/1999 | Yu | 323/314 |
| 5,886,565 | A | 3/1999 | Yasui et al. | |
| 6,018,235 | A * | 1/2000 | Mikuni | 323/313 |
| 6,201,435 | B1 * | 3/2001 | Chou | 327/543 |
| 6,356,064 | B1 * | 3/2002 | Tonda | 323/313 |
| 6,531,857 | B2 * | 3/2003 | Ju | 323/316 |
| 6,815,941 | B2 * | 11/2004 | Butler | 323/313 |
| 6,933,769 | B2 * | 8/2005 | Koelling | 327/538 |
| 6,998,902 | B2 * | 2/2006 | Sugimura | 327/539 |
| 7,321,256 | B1 * | 1/2008 | Vasudevan | 327/539 |
| 7,495,504 | B2 * | 2/2009 | Kinoshita et al. | 327/539 |
| 7,498,869 | B2 * | 3/2009 | Abadeer et al. | 327/541 |
| 7,589,573 | B2 * | 9/2009 | Tang et al. | 327/143 |
| 2005/0046466 | A1 * | 3/2005 | Koelling | 327/539 |
| 2007/0210856 | A1 * | 9/2007 | Uehara | 327/539 |
| 2009/0146733 | A1 * | 6/2009 | Nakajikkoku | 327/543 |

FOREIGN PATENT DOCUMENTS

| | | |
|---|---|---|
| JP | 05-114291 | 5/1993 |
| JP | 10-105258 | 4/1998 |
| JP | 11-024768 | 1/1999 |

* cited by examiner

*Primary Examiner* — Thomas J Hiltunen
(74) *Attorney, Agent, or Firm* — Foley & Lardner LLP

(57) ABSTRACT

To solve the problem of the conventional reference voltage generation circuit in that an output voltage exceeds a predetermined voltage value, there is provided a reference voltage generation circuit including: a voltage generation circuit provided between a first power supply and a second power supply, to output an output voltage to an output terminal; an auxiliary start-up circuit provided between the output terminal and the first power supply, to supply a voltage of the first power supply to the output terminal; and a control circuit that switches the auxiliary start-up circuit between an operating state and a non-operating state according to a value of a voltage at the output terminal.

10 Claims, 5 Drawing Sheets

REFERENCE VOLTAGE GENERATION CIRCUIT AND START-UP CONTROL METHOD THEREFOR

BACKGROUND

1. Field of the Invention

The present invention relates to a reference voltage generation circuit and a start-up control method therefor. In particular, the present invention relates to a reference voltage generation circuit that generates a reference voltage lower than a power supply voltage, and to a start-up control method therefor.

2. Description of Related Art

In semiconductor devices adopting a microfabrication process (for example, microcomputer), a withstand voltage of a transistor device is lowered along with the miniaturization. Meanwhile, a power supply voltage supplied to a semiconductor device on a substrate having the semiconductor device mounted thereon is determined according to a demand from a user of the semiconductor device. Under the circumstances, a transistor device having a withstand voltage equal to or higher than the power supply voltage is used as an I/O circuit having an interface function with the outside, and an internal functional circuit is formed by using the microfabrication process, thereby realizing a high-speed and highly integrated functional circuit. In this case, a step-down voltage is supplied to the functional circuit, which is formed by the microfabrication process, from a regulator incorporated in the functional circuit. In this situation, a reference voltage generation circuit is required in some cases in order to set a value of an output voltage of the regulator.

Japanese Unexamined Patent Application Publication No. 11-24768 discloses a reference voltage generation circuit for completing the start-up rapidly while preventing an output voltage from exceeding a set voltage. FIG. 4 shows a circuit diagram of a reference voltage generation circuit 100 disclosed in Japanese Unexamined Patent Application Publication No. 11-24768. As shown in FIG. 4, the reference voltage generation circuit 100 includes PMOS transistors P1 to P6, NMOS transistors N1 and N2, resistors R1 and R2, and diodes D1 to D3. The source terminals of the PMOS transistors P1 to P6 are each connected to a power supply terminal Vdd on the high potential side and are supplied with a power supply voltage. The gate terminals of the PMOS transistors P1, P2, P3, and P4 are connected in common, and those PMOS transistors constitute a current mirror. The drain terminal of the PMOS transistor P4 is connected to one end of a capacitor C, the gate terminal of the PMOS transistor P5, and the gate terminal of the PMOS transistor P6. The drain terminal of the PMOS transistor P1 is connected to the drain terminal of the NMOS transistor N1. Note that the gate terminal and the drain terminal of the PMOS transistor P2 are connected in common. The drain terminal of the PMOS transistor P2 is connected to the drain terminal of the NMOS transistor N2. The gate terminal of the NMOS transistor N1 is commonly connected to the gate terminal of the NMOS transistor N2, and the NMOS transistor N1 and the NMOS transistor N2 constitute a current mirror. Note that the gate terminal and the drain terminal of the NMOS transistor N1 are connected in common. Further, the gate terminals of the NMOS transistors N1 and N2 are connected to each of the drain terminal of the PMOS transistor P1 and the drain terminal of the PMOS transistor P5.

The source terminal of the NMOS transistor N1 is connected to the anode terminal of the diode D1, and the source terminal of the NMOS transistor N2 is connected to the anode terminal of the diode D2 through the resistor R1. A junction area ratio between the diode D1 and the diode D2 is set to 1:N. The cathode terminals of the diode D1 and the diode D2 are each connected to a power supply terminal Vss on the low potential side and are supplied with a ground potential. The drain terminal of the PMOS transistor P3 is connected to the anode terminal of the diode D3 through the resistor R2. The cathode terminal of the diode D3 is connected to the power supply terminal Vss on the low potential side. A node between the PMOS transistor P3 and the resistor R2 serves as an output node and is connected to an output terminal Vo. The PMOS transistor P3 has the source terminal connected to a power supply terminal Vdd on the high potential side, the drain terminal connected to the output terminal Vo, and the gate terminal connected to the drain terminal of the PMOS transistor P4.

Note that, in the reference voltage generation circuit 100, the PMOS transistors P4 and P5 and the capacitor C constitute a start-up circuit 111, and the PMOS transistors P1 to P3, the NMOS transistors N1 and N2, the resistors R1 and R2, and the diodes D1 to D3 constitute a voltage generation circuit 110. Further, the PMOS transistor P6 constitutes an auxiliary start-up circuit 112.

Next, an operation of the reference voltage generation circuit 100 is described. Hereinafter, it is assumed that, in the reference voltage generation circuit, the PMOS transistors P1 to P3 have the same gate length and the same gate width and the NMOS transistors N1 and N2 also have the same gate length and the same gate width. In this case, a set voltage Vref is obtained by the following equation (1).

$$V\mathrm{ref}=M\cdot(k\cdot T/q)\cdot\ln N+VF(D3) \quad (1)$$

where M represents resistance ratio ((resistance value of R2)/(resistance value of R1), N represents junction area ratio ((junction area of D2)/(junction area of D1), q represents charge amount of electrons, k represents Boltzmann constant, T represents absolute temperature, and VF(D3) represents forward voltage of the diode D3.

The start-up circuit 111 has a function of prompting the voltage generation circuit 110 to start after power-on. After power-on, the PMOS transistor P6 is rendered conductive, because the gate terminal of the PMOS transistor P6 is grounded through the capacitor C. For this reason, the voltage at the output terminal Vo follows the power supply voltage of the power supply terminal Vdd on the high potential side while being pulled up by the PMOS transistor P6, and thus, the voltage at the output terminal Vo increases. Further, immediately after power-on, the PMOS transistor P is rendered conductive, because the gate terminal of the PMOS transistor P5 is also grounded through the capacitor C. Accordingly, the NMOS transistors N1 and N2 are also rendered conductive, and the voltage generation circuit 110 is rapidly started. After that, the capacitor C is charged with a drain current of the PMOS transistor P4 constituting a current mirror together with the PMOS transistor P2. Then, when the amount of charge supplied to the capacitor C increases, the gate terminals of the PMOS transistors P5 and P6 are at the same potential as the power supply voltage. As a result, the PMOS transistors P5 and P6 are rendered non-conductive. Thus, the transition to the non-operating state of the start-up circuit 111 is carried out and the pull-up operation by the PMOS transistor P6 is released.

Accordingly, in the reference voltage generation circuit 100, when the voltage generation circuit 110 is started, the transition of the start-up circuit 111 to the non-operating state is carried out and the pull-up operation is released, thereby enabling rapid start-up while preventing the output voltage Vo from exceeding the set voltage Vref. Similar technologies are disclosed in Japanese Unexamined Patent Application Publication Nos. 05-114291 and 10-105258.

SUMMARY

However, the present inventors have found that the following problem. In the above-mentioned related art, when a current to be consumed by the reference voltage generation circuit is reduced so as to reduce power consumption, the capacitance component attached to the MOS transistor is charged with a small amount of current, which slows down the start-up of the voltage generation circuit 110. Further, it takes a long time to complete charging of the capacitor C of the start-up circuit 111. As a result, even after the power supply voltage reaches the set voltage Vref, the release of the pull-up operation is not completed by the start-up circuit 111 and the auxiliary start-up circuit 112.

In this case, after the power supply voltage exceeds the set voltage Vref, the voltage at the output terminal Vo remains pulled up at the power supply voltage Vdd during a period from the time when the capacitor C is charged and the time when the pull-up operation is released. Therefore, according to the related art, when the power consumption is reduced, there arises a problem in that the output voltage Vo exceeds the set voltage Vref. FIG. 5 shows a timing diagram of an operation of the reference voltage generation circuit 100 in the case where the problem arises. As shown in FIG. 5, in the reference voltage generation circuit according to the related art, the output voltage rises up to the power supply voltage level during a period from the start-up to a time t0. The present inventor has found a problem that, when the rise of the output voltage occurs, an internal circuit connected to the output terminal Vo may be destroyed.

A first exemplary aspect of an embodiment of the present invention is a reference voltage generation circuit including: a voltage generation circuit provided between a first power supply and a second power supply, to output an output voltage to an output terminal; an auxiliary start-up circuit connected between the output terminal and the first power supply, to supply a voltage of the first power supply to the output terminal; and a control circuit that switches the auxiliary start-up circuit between an operating state and a non-operating state according to a value of a voltage at the output terminal.

A second exemplary aspect of an embodiment of the present invention is a start-up control method for a reference voltage generation circuit, the reference voltage generation circuit including: a voltage generation circuit provided between a first power supply and a second power supply, to output an output voltage to an output terminal; and an auxiliary start-up circuit connected between the output terminal and the first power supply, to supply a voltage of the first power supply to the output terminal, the start-up control method including: switching the auxiliary start-up circuit between an operating state and a non-operating state according to a value of a voltage at the output terminal.

The reference voltage generation circuit according to the present invention switches the auxiliary start-up circuit between the operating state and the non-operating state according to a value of a reference voltage output from the voltage generation circuit. Therefore, the auxiliary start-up circuit enables rapid start-up while preventing the value of the output node from exceeding a set voltage.

The reference voltage generation circuit according to the present invention is capable of achieving the rapid start-up while preventing the output voltage from exceeding the set voltage.

BRIEF DESCRIPTION OF THE DRAWINGS

The above and other exemplary aspects, advantages and features will be more apparent from the following description of certain exemplary embodiments taken in conjunction with the accompanying drawings, in which.

DETAILED DESCRIPTION OF THE EXEMPLARY EMBODIMENTS

First Exemplary Embodiment

Figure 1:
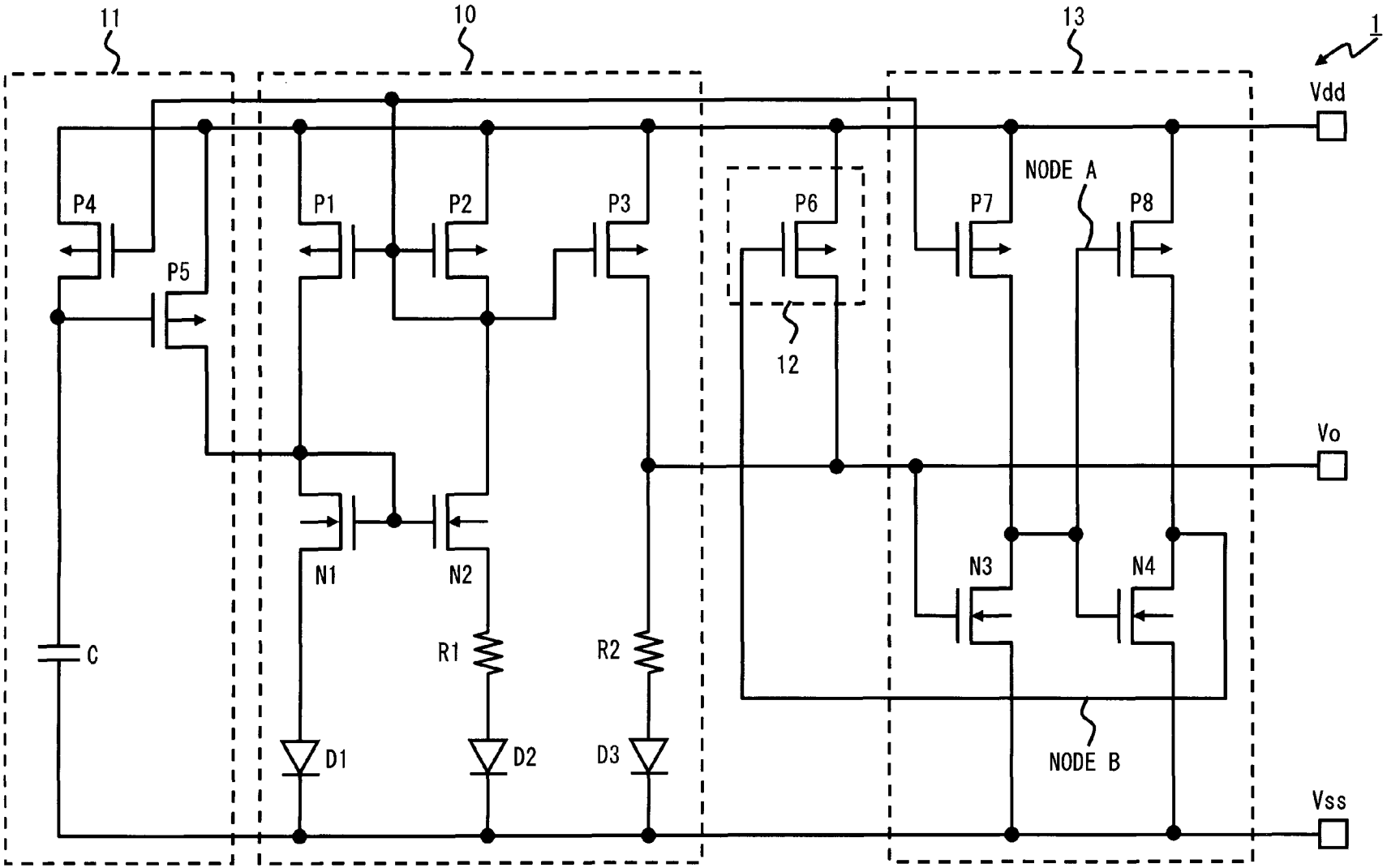
FIG. 1 is a circuit diagram showing a reference voltage generation circuit according to a first exemplary embodiment of the present invention.

Hereinafter, exemplary embodiments of the present invention will be described with reference to the accompanying drawings. FIG. 1 shows a block diagram of a reference voltage generation circuit 1. As shown in FIG. 1, the reference voltage generation circuit 1 includes a voltage generation circuit 10, a start-up circuit 11, an auxiliary start-up circuit 12, and a control circuit 13.

The voltage generation circuit 10 outputs a reference voltage having a voltage value equal to that of a preset voltage. The voltage generation circuit 10 includes PMOS transistors P1 to P3, NMOS transistors N1 and N2, resistors R1 and R2, and diodes D1 to D3. The start-up circuit 11 assists the operation of the voltage generation circuit 10 after power-on. The start-up circuit 11 includes PMOS transistors P4 and P5 and a capacitor C. The auxiliary start-up circuit 12 assists the rise of an output voltage output from an output node of the voltage generation circuit 10. The auxiliary start-up circuit 12 includes a PMOS transistor P6. The control circuit 13 controls switching between operation and non-operation of the auxiliary start-up circuit 12 based on the voltage value of the reference voltage. The control circuit 13 includes PMOS transistors P7 and P8 and NMOS transistors N3 and N4.

First, the connection between the elements of the voltage generation circuit 10 is described. The source terminal of each of the PMOS transistors P1 to P3 is connected to a first power supply (for example, power supply terminal) Vdd and is supplied with a power supply voltage. The gate terminals of the PMOS transistors P1 to P3 are connected in common. Further, the gate terminal and the drain terminal of the PMOS transistor P2 are connected in common. That is, the PMOS transistors P1 to P3 constitute a current mirror. The gate terminals of the NMOS transistors N1 and N2 are connected in common, and the gate terminal and the drain terminal of the NMOS transistor N1 are connected in common. That is, the NMOS transistors N1 and N2 constitute a current mirror.

The drain terminal of the NMOS transistor N1 is connected to the drain terminal of the PMOS transistor P1. The source terminal of the NMOS transistor N1 is connected to the anode terminal of the diode D1. The cathode terminal of the diode D1 is connected to a second power supply (for example, ground terminal) Vss and is supplied with a ground voltage.

The drain terminal of the NMOS transistor N2 is connected to the drain terminal of the PMOS transistor P2. The source terminal of the NMOS transistor N2 is connected to the anode terminal of the diode D2 through the resistor R1. The cathode terminal of the diode D2 is connected to the ground terminal Vss. The drain terminal of the PMOS transistor P3 is connected to the anode terminal of the diode D3 through the resistor R2. The cathode terminal of the diode D3 is connected to the ground terminal Vss. A node between the PMOS transistor P3 and the resistor R2 is an output node connected to an output terminal Vo.

The reference voltage output from the voltage generation circuit 10 is herein described. Assuming that the PMOS transistors P1 to P3 have the same gate length and the same gate width and that the NMOS transistors N1 and N2 also have the same gate length and the same gate width, a set voltage Vref is obtained by the following equation (2). The voltage generation circuit 10 outputs an output voltage having a voltage value represented by the set voltage Vref.

$$Vref = M \cdot (k \cdot T/q) \cdot \ln N + VF(D3) \quad (2)$$

where M represents resistance ratio ((resistance value of R2)/(resistance value of R1)), N represents junction area ratio ((junction area of D2)/(junction area of D1)), q represents amount of charge of electrons, k represents Boltzmann constant, T represents absolute temperature, and VF(D3) represents forward voltage of the diode D3.

Next, the connection between the elements of the blocks other than the voltage generation circuit 10 is described. The gate terminal of the PMOS transistor P4 is commonly connected to the gate terminal of the PMOS transistor P2, and the PMOS transistor P4 constitutes a current mirror together with the PMOS transistors P1 to P3. The drain terminal of the PMOS transistor P4 is connected to the ground terminal Vss through the capacitor C. The PMOS transistor P5 has a source terminal connected to the power supply terminal Vdd, a gate terminal connected to the drain terminal of the PMOS transistor P4, and a drain terminal connected to the drain terminal of the NMOS transistor N1. The PMOS transistor P5 is rendered conductive depending on the amount of charge accumulated in the capacitor C (or voltage at the drain terminal of the PMOS transistor P4). During a period in which the PMOS transistor P5 is in the conductive state, a current is supplied from the power supply terminal Vdd to the drain terminal of the NMOS transistor N1.

The PMOS transistor P6 of the auxiliary start-up circuit 12 has a source terminal connected to the power supply terminal Vdd, a drain terminal connected to the output terminal Vo, and a gate terminal connected to an output node (node B of FIG. 1) of the control circuit. The PMOS transistor P6 is rendered conductive when the potential of the node B is at low level (for example, ground voltage), and supplies the power supply voltage to the output node. Meanwhile, when the potential of the node B is at high level (for example, power supply voltage), the PMOS transistor P6 is rendered non-conductive.

The control circuit 13 includes a first transistor (NMOS transistor N3) that monitors the voltage at the output terminal Vo. According to an exemplary embodiment of the present invention, the voltage at the output terminal Vo is compared with a preset switching voltage (for example, threshold voltage of the NMOS transistor N3). When the voltage at the output terminal Vo is lower than the threshold voltage of the NMOS transistor N3, the value of the node B is set to the low level, and when the voltage at the output terminal Vo is higher than the threshold voltage, the value of the node B is set to the high level. A signal output through the node B serves as a control signal for the auxiliary start-up circuit 12. The switching voltage is preferably set to a value lower than the set voltage.

The NMOS transistor N3 has a source terminal connected to the ground terminal Vss, a gate terminal connected to the output node (or output terminal Vo) of the voltage generation circuit 10, and a drain terminal connected to the drain terminal of the PMOS transistor P7. The PMOS transistor P7 has a source terminal connected to the power supply terminal Vdd, and a gate terminal connected to the gate terminal of the PMOS transistor P2. That is, the PMOS transistor P7 constitutes a current mirror together with the PMOS transistors P1 to P3. In other words, the PMOS transistor P7 operates as a current source for the NMOS transistor N3. Further, a node between the PMOS transistor P7 and the NMOS transistor N3 is a node at which the detection result of the voltage at the output terminal Vo is obtained, and is hereinafter referred to as "node A".

The NMOS transistor N4 and the PMOS transistor P8 constitute an inverter provided between the power supply terminal Vdd and the ground terminal Vss. The gate terminal of the NMOS transistor N4 and the gate terminal of the PMOS transistor P8 are each connected to the node A. Further, a node between the drain terminal of the NMOS transistor N4 and the drain terminal of the PMOS transistor P8 serves as the output node (node B) of the control circuit 13.

Figure 2:
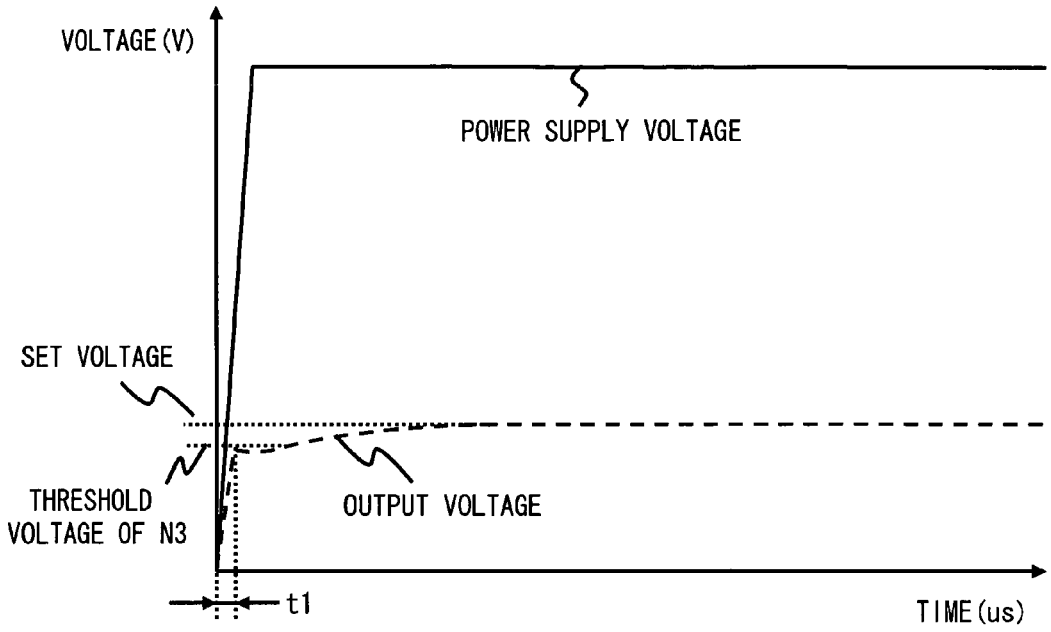
FIG. 2 is a timing diagram showing an operation of the reference voltage generation circuit according to the first exemplary embodiment of the present invention.

Next, FIG. 2 shows a timing diagram of an operation of the power supply of the reference voltage generation circuit 1 at the time of power-on. The operation of the reference voltage generation circuit 1 is described with reference to FIG. 2. First, when the power supply is turned on and the power supply voltage rises, the PMOS transistors P1 to P4 operate. In response to this, the PMOS transistor P4 charges the capacitor C. In this case, during a period in which the capacitor C is not sufficiently charged, the PMOS transistor P5 is rendered conductive, because the voltage at the gate terminal of the PMOS transistor P5 (or voltage at the node between the capacitor C and the PMOS transistor P4) is low. Thus, the start-up circuit 11 supplies a current to the NMOS transistor N1 of the voltage generation circuit 10 through the PMOS transistor P5 to assist the start-up of the voltage generation circuit 10.

Meanwhile, in the control circuit 13, the NMOS transistor N3 is rendered non-conductive, because the voltage at the output node (hereinafter, referred to as "output voltage") of the voltage generation circuit 10 is low. On the other hand, the PMOS transistor P7 operates together with the PMOS transistors P1 to P3, and causes a current to flow to the node A. As a result, the voltage at the node A rises, and when the voltage is inverted by the inverter constituted by the PMOS transistor P8 and the NMOS transistor N4, the voltage at the node B (control signal) becomes low level. When the voltage at the node B (control signal) is at low level, the PMOS transistor P6 is rendered conductive. Accordingly, the output voltage of the voltage generation circuit 10 rises as the power supply voltage rises.

Then, when the output voltage reaches the threshold voltage of the NMOS transistor N3, the NMOS transistor N3 is rendered conductive, which causes the voltage at the node A to drop. As a result, the voltage at the node A becomes low level, and when the voltage is inverted by the inverter constituted by the PMOS transistor P8 and the NMOS transistor N4, the voltage at the node B (control signal) becomes high level. The PMOS transistor P6 is rendered non-conductive in response to the change in voltage at the node B. Accordingly, after reaching the threshold voltage of the NMOS transistor N3, the output voltage rises up to the set voltage Vref in accordance with the operation of the voltage generation circuit 10. Note that, when the capacitor C is sufficiently charged and the voltage at the drain terminal of the PMOS transistor P4 rises, the PMOS transistor P5 of the start-up circuit 11 is rendered non-conductive.

In short, when the output voltage is equal to or lower than the switching voltage (threshold voltage of the NMOS transistor N3 according to an exemplary embodiment of the present invention), the reference voltage generation circuit 1 renders the PMOS transistor P6 conductive, thereby rapidly raising the output voltage (period t1 of FIG. 2). Then, after the output voltage reaches the switching voltage, the reference voltage generation circuit 1 causes the output voltage to rise up to the set voltage in accordance with the operation of the voltage generation circuit 10.

As described above, in the reference voltage generation circuit 1 according to an exemplary embodiment of the present invention, the control circuit allows the output voltage to rapidly rise by using the PMOS transistor P6 during the period in which the output voltage is low. Further, after the output voltage reaches the switching voltage, the output voltage is set to be equal to the set voltage in accordance with the operation of the voltage generation circuit 10. Therefore, the output voltage output from the reference voltage generation circuit 1 can be prevented from exceeding the set voltage, and the rapid rise of the output voltage can be achieved.

Further, in the reference voltage generation circuit 1 according to an exemplary embodiment of the present invention, since the output voltage does not exceed the set voltage, it is possible to prevent an excessive voltage from being applied to a circuit connected to a subsequent stage. Accordingly, the circuit connected to the subsequent stage can be constituted by a device having a low withstand voltage, and the subsequent-stage circuit can be miniaturized.

Moreover, according to an exemplary embodiment of the present invention, a pulled-up state caused by the PMOS transistor P6 can be released independently of the operation of the start-up circuit 11. That is, even when a charging current to the capacitor C of the start-up circuit 11 is reduced, the pulled-up state is rapidly released. Thus, according to the reference voltage generation circuit 1, it is possible to design the voltage generation circuit 10 and the start-up circuit 11 with low power consumption while preventing an overvoltage state of the output voltage.

Second Exemplary Embodiment

Figure 3:
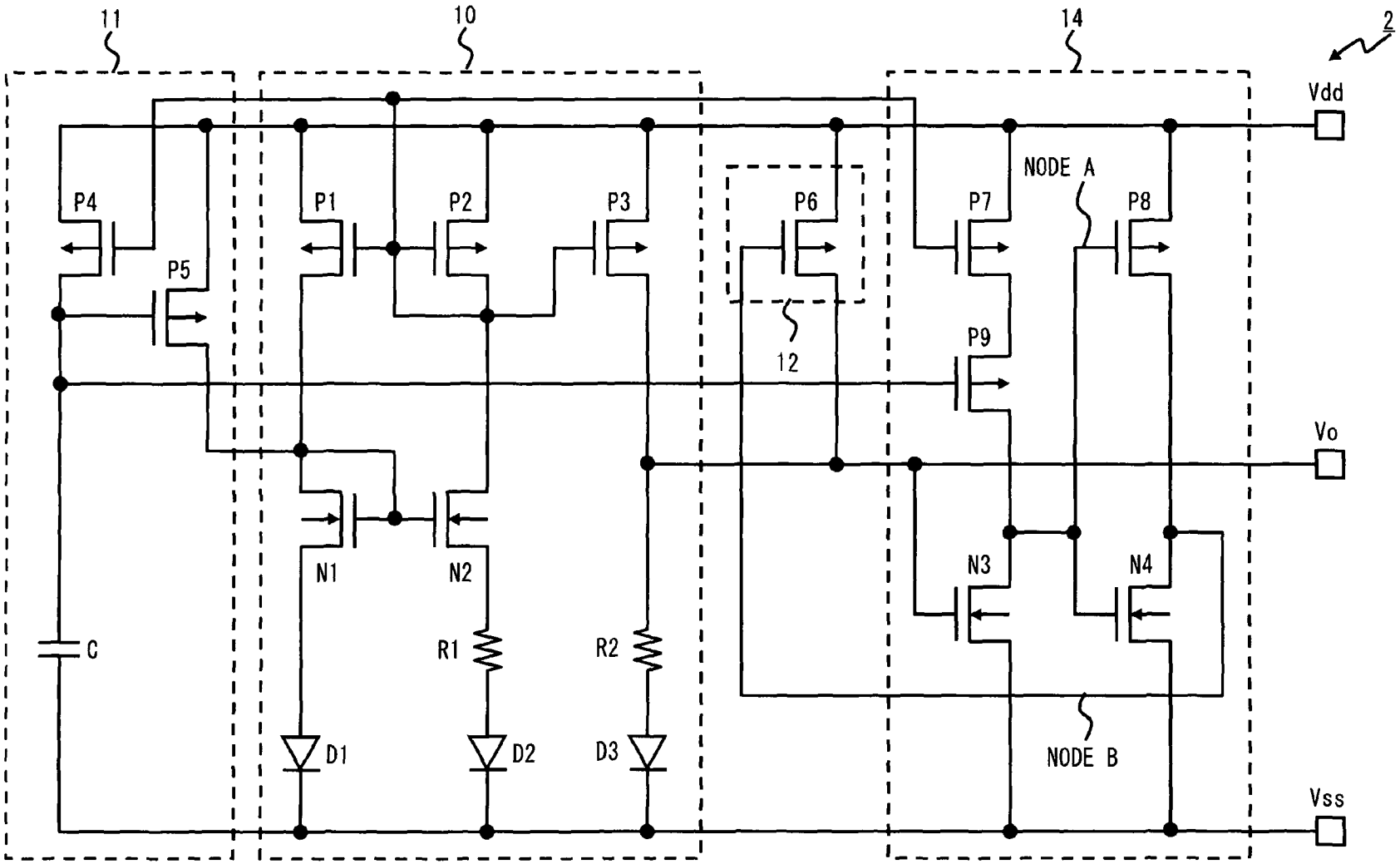
FIG. 3 is a circuit diagram showing a reference voltage generation circuit according to a second exemplary embodiment of the present invention.
Figure 4:
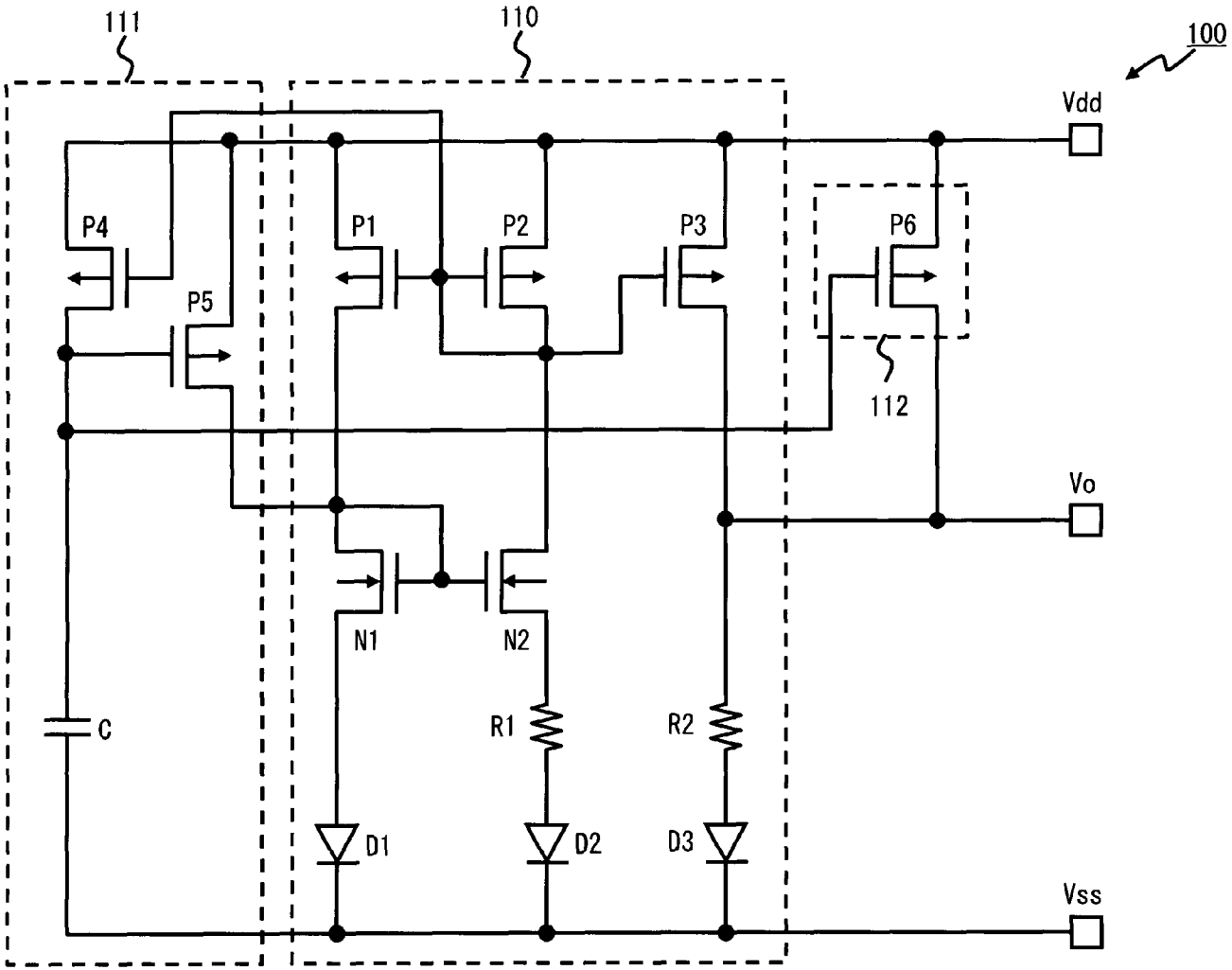
PRIOR ART Fig. 4
FIG. 4 is a circuit diagram showing a reference voltage generation circuit according to the related art.
Figure 5:
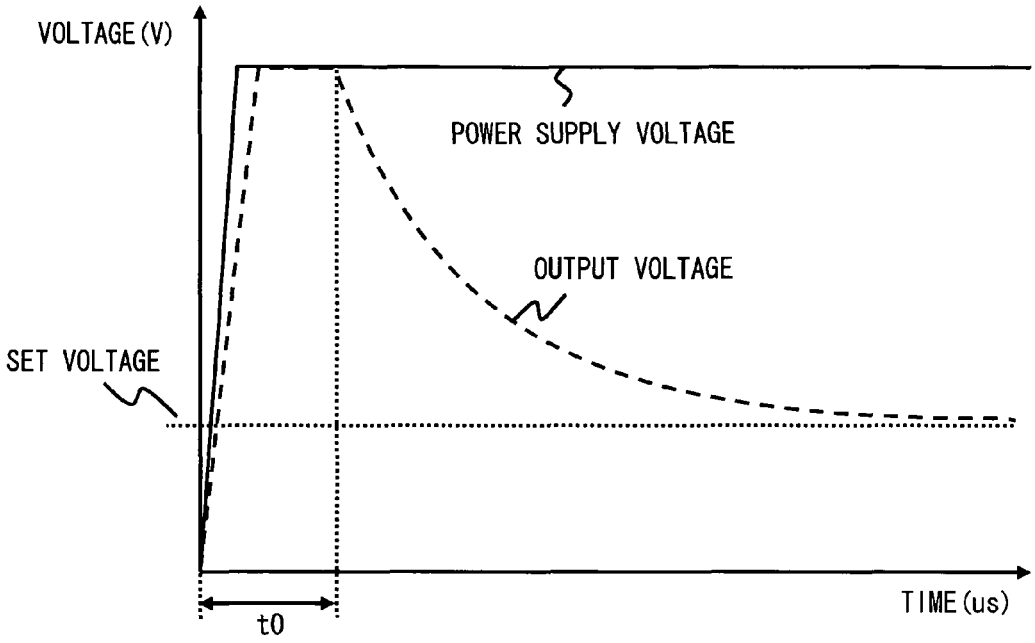
FIG. 5 is a timing diagram for explaining a problem of the reference voltage generation circuit according to the related art.

FIG. 3 shows a circuit diagram of a reference voltage generation circuit 2 according to a second exemplary embodiment of the present invention. As shown in FIG. 3, the reference voltage generation circuit 2 includes a control circuit 14 which is obtained by adding a PMOS transistor P9 to the control circuit 13. In the control circuit 13, in the state where the output voltage of the reference voltage generation circuit 1 reaches the set voltage, the NMOS transistor N3 is rendered conductive and the PMOS transistor P7 is also rendered conductive. Accordingly, in the control circuit 13, in the state where the output voltage of the reference voltage generation circuit 1 reaches the set voltage, a flow-through current flows from the power supply terminal Vdd to the ground terminal Vss through the PMOS transistor P7 and the NMOS transistor N3. The PMOS transistor P9 prevents the flow-through current from flowing.

The PMOS transistor P9 has a source terminal connected to the drain terminal of the PMOS transistor P7, a drain terminal connected to the drain terminal of the NMOS transistor N3, and a gate terminal connected to the drain terminal of the PMOS transistor P4. That is, in a similar manner as the PMOS transistor P5, a voltage at which the PMOS transistor P9 is rendered conductive is supplied to the gate terminal of the PMOS transistor P9 during a period in which the start-up circuit 11 operates, and the PMOS transistor P9 is rendered non-conductive in response to transition of the start-up circuit 11 to the non-operating state. Thus, during the period in which the start-up circuit 11 operates after power-on, the control circuit 14 operates in a similar manner as the control circuit 13. Meanwhile, after the start-up circuit 11 shifts to the non-operating state, the flow-through current flowing from the power supply terminal Vdd to the ground terminal Vss through the PMOS transistor P7 and the NMOS transistor N3 is interrupted by the PMOS transistor P9.

As described above, the reference voltage generation circuit 2 according to the second exemplary embodiment of the present invention prevents the flow-through current flowing through the reference voltage generation circuit 1 according to the first exemplary embodiment of the present invention. Therefore, the reference voltage generation circuit 2 is capable of reducing the power consumption compared to the reference voltage generation circuit 1.

The first and second exemplary embodiments can be combined as desirable by one of ordinary skill in the art. Furthermore, the circuit configuration of each of the start-up circuit and the voltage generation circuit is shown for illustrative purposes only, and the circuit configuration can be arbitrarily changed depending on systems. For example, it is possible to employ a configuration in which the polarities of the NMOS transistor and the PMOS transistor are interchanged.

While the invention has been described in terms of several exemplary embodiments, those skilled in the art will recognize that the invention can be practiced with various modifications within the spirit and scope of the appended claims and the invention is not limited to the examples described above.

Further, the scope of the claims is not limited by the exemplary embodiments described above.

Furthermore, it is noted that, Applicant's intent is to encompass equivalents of all claim elements, even if amended later during prosecution.

What is claimed is:

1. A reference voltage generation circuit, comprising:

a voltage generation circuit provided between a first power supply and a second power supply, to output an output voltage to an output terminal;

an auxiliary start-up circuit connected between the output terminal and the first power supply, to supply a voltage of the first power supply to the output terminal; and a control circuit that switches the auxiliary start-up circuit between an operating state and a non-operating state according to a value of a voltage at the output terminal, wherein the voltage generation circuit includes first and second transistors and a diode connected in series between the first and second power supply, the control circuit includes third and fourth transistors coupled in series between the first and second power supply, and the third transistor includes a gate connected to a gate of the first transistor, and the fourth transistor monitors the value of the voltage of the output terminal, wherein the voltage generation circuit comprises a bandgap voltage generator that generates the output voltage based on a bandgap voltage of a semiconductor.

2. The reference voltage generation circuit according to claim 1, wherein the control circuit switches the auxiliary start-up circuit to the operating state when the voltage at the output terminal is equal to or lower than a preset switching voltage value.

3. The reference voltage generation circuit according to claim 1, wherein the control circuit switches the auxiliary start-up circuit between the operating state and the non-operating state based on a threshold value of the fourth transistor.

4. The reference voltage generation circuit according to claim 1, wherein:

the fourth transistor includes a source connected to the second power supply, a drain connected to the first power supply through the third transistor, and a gate connected to the output terminal; and the control circuit outputs a control signal for controlling the auxiliary start-up circuit according to a voltage at the drain of the fourth transistor.

5. The reference voltage generation circuit according to claim 1, wherein the first and third transistors operate as a current mirror.

6. The reference voltage generation circuit according to claim 1, wherein the voltage generation circuit further includes an output circuit to provide the output voltage for the output terminal, and the output circuit is supplied with a bias current by the first and second transistors and the diode.

7. A reference voltage generation circuit, comprising:

a voltage generation circuit provided between a first power supply and a second power supply, to output an output voltage to an output terminal;

an auxiliary start-up circuit connected between the output terminal and the first power supply, to supply a voltage of the first power supply to the output terminal;

a control circuit that switches the auxiliary start-up circuit between an operating state and a non-operating state according to a value of a voltage at the output terminal, wherein the control circuit comprises a first transistor that monitors the value of the voltage at the output terminal and switches the auxiliary start-up circuit between the operating state and the non-operating state based on a threshold value of the first transistor; and a start-up circuit that operates at power-on of the first power supply to assist an operation of the voltage generation circuit, wherein the control circuit further comprises a second transistor provided between the first power supply and the first transistor, to interrupt a current flowing from the first power supply to the second power supply through the first transistor, in response to transition of the start-up circuit to a non-operating state.

8. A reference voltage generation circuit, comprising:

a voltage generation circuit provided between a first power supply and a second power supply, to output an output voltage to an output terminal;

an auxiliary start-up circuit connected between the output terminal and the first power supply, to supply a voltage of the first power supply to the output terminal;

a control circuit that switches the auxiliary start-up circuit between an operating state and a non-operating state according to a value of a voltage at the output terminal, wherein the voltage generation circuit includes first and second transistors and a diode connected in series between the first and second power supply, the control circuit includes third and fourth transistors coupled in series between the first and second power supply, and the third transistor includes a gate connected to a gate of the first transistor, and the fourth transistor monitors the value of the voltage of the output terminal; and a start-up circuit that operates at power-on of the first power supply to assist an operation of the voltage generation circuit, the start-up circuit comprising a capacitor and a one transistor, the capacitor connected between the second power supply and a gate of the one transistor.

9. The reference voltage generation circuit according to claim 8, wherein the start-up circuit further comprises another transistor having a drain connected to the gate of the one transistor, and a source connected to the first power supply.

10. A start-up control method for a reference voltage generation circuit, the reference voltage generation circuit comprising: a voltage generation circuit provided between a first power supply and a second power supply, to output an output voltage to an output terminal; a start-up circuit provided between the first power supply and the second power supply; and an auxiliary start-up circuit connected between the output terminal and the first power supply, to supply a voltage of the first power supply to the output terminal, the start-up control method comprising:

operating the start-up circuit at power-on of the first power supply to assist an operation of the voltage generation circuit;

monitoring the value of the voltage at the output terminal with a first transistor of the control circuit;

switching the auxiliary start-up circuit between an operating state and a non-operating state based on a threshold value of the first transistor; and interrupting, via a second transistor of the control circuit, a current flowing from the first power supply to the second power supply through the first transistor, in response to transition of the start-up circuit to a non-operating state.

* * * * *